US007600988B2

(12) United States Patent
Doerr et al.

(10) Patent No.: US 7,600,988 B2
(45) Date of Patent: Oct. 13, 2009

(54) AIR-DEMAND-CONTROLLED COMPRESSOR ARRANGEMENT, PARTICULARLY FOR COMMERCIAL VEHICLES

(75) Inventors: Wolfgang Doerr, Eichenau (DE); Eduard Gerum, Rosenheim (DE)

(73) Assignee: KNORR-BREMSE Systeme fuer Nutzfahrzeuge GmbH, Munich (DE)

( * ) Notice: Subject to any disclaimer, the term of this patent is extended or adjusted under 35 U.S.C. 154(b) by 707 days.

(21) Appl. No.: 10/652,619

(22) Filed: Sep. 2, 2003

(65) Prior Publication Data

US 2004/0136840 A1 Jul. 15, 2004

(30) Foreign Application Priority Data

Aug. 30, 2002 (DE) ..... 102 40 162

(51) Int. Cl.
*F04B 17/00* (2006.01)

(52) U.S. Cl. ..... 417/417; 417/212; 280/124.16

(58) Field of Classification Search ..... 417/423.5, 417/364, 417, 212, 15, 223, 362, 374; 280/124.157, 280/124.16, 180; 180/53.1, 53.8
See application file for complete search history.

(56) References Cited

U.S. PATENT DOCUMENTS 3,365,906 A 1/1968 Zadig
5,039,281 A 8/1991 Johnston
5,125,806 A * 6/1992 Quick et al. ..... 417/423.6
5,906,480 A * 5/1999 Sabelstrom et al. ..... 417/364

FOREIGN PATENT DOCUMENTS

| | | | |
|---|---|---|---|
| DE | 28 01 812 | | 7/1979 |
| DE | 38 14 750 | A1 | 2/1989 |
| DE | 100 34 735 | A1 | 3/2001 |
| EP | 0 093 253 | B1 | 11/1883 |
| EP | 0 106 612 | A1 | 4/1984 |
| GB | 2012890 | A * | 8/1979 |
| GB | 2 086 621 | A | 5/1982 |

OTHER PUBLICATIONS

Article entitled "High-Performance Compressors" by Knorr-Bremse Systeme fuer Nutzfahrzeuge GmbH (No. P-3505-DE-01).
European Search Report dated May 29, 2009 (six (6) pages).

* cited by examiner

*Primary Examiner*—Michael Cuff
*Assistant Examiner*—Vikansha S Dwivedi
(74) *Attorney, Agent, or Firm*—Crowell & Moring LLP

(57) ABSTRACT

Air-demand-controlled compressor arrangement, particularly for commercial vehicles, includes a motor unit for generating a rotating movement which, by way of an interposed rotational-speed-transmitting transmission unit, drives a compressor unit for generating compressed air from ambient air. A control unit triggers the generating of compressed air in the case of a compressed-air demand. The transmission unit is constructed in the manner of a transmission whose rotational speed can be varied, and the control unit interacts with the transmission unit in order to adapt the rotational speed of the transmission unit corresponding to the compressed-air demand.

8 Claims, 1 Drawing Sheet

AIR-DEMAND-CONTROLLED COMPRESSOR ARRANGEMENT, PARTICULARLY FOR COMMERCIAL VEHICLES

BACKGROUND AND SUMMARY OF THE INVENTION

The present invention relates to an air-demand-controlled compressor arrangement, particularly for commercial vehicles, having a motor unit for generating a rotating movement which, by way of an interposed rotational-speed-transmitting transmission unit, drives a compressor unit for generating compressed air from the ambient air. A control unit triggers the generating of compressed air when a compressed-air demand is determined.

Compressor arrangements of the type which is of interest here are predominantly installed in commercial vehicles in order to implement the procurement of compressed air from the on-board compressed-air system. The compressed-air system on-board a commercial vehicle is required, in particular for supplying the braking system, the air suspension, trailers and accessories. For this purpose, the compressor arrangement generates compressed air of up to 12.5 bar.

The product information "High-Performance Compressors" of the firm KNORR-BREMSE Systeme für Nutzfahrzeuge GmbH (Printing No. P-3505DE-01) reveals a compressor unit which is constructed in the form of a piston compressor. A crankshaft rotatingly disposed in a compressor housing converts an input-side rotating movement, by means of a crankshaft drive, into a linear movement of an assigned piston housed in a cylinder. The piston, interacting with a valve device, takes in ambient air and subsequently compresses the latter. Depending on the desired delivery capacity, the compressor unit may be of a single-cylinder or multi-cylinder construction.

Customarily, the driving of the compressor unit takes place by way of the rotating movement generated by the internal-combustion engine of the commercial vehicle. In most application cases, a rotational-speed-transmitting transmission unit is interposed between the internal-combustion engine as the motor unit and the compressor unit. In this case, the transmission unit is constructed as a spur gear transmission with a fixed transmission ratio, which gears up the rotational speed supplied by the motor unit on the input side in order to drive the compressor unit.

Furthermore, in the case of this known compressor arrangement, a control is provided which ensures that the operation of the compressor unit can be started only when a compressed-air demand exists in the compressed-air system of the commercial vehicle. In most cases, the compressed-air demand is determined by way of a pressure sensor connected with the system pressure. When the system pressures falls below a defined threshold pressure, the compressor unit is started in order to again build up a sufficient air pressure. Additional pressure reservoirs are usually used in the compressed-air system, for storing the built-up pressure.

In order to implement such a demand control for starting the compressor unit, the compressor unit can be switched between a delivery phase and a no load phase. In the delivery phase, compressed air is generated from the ambient air and is fed into the compressed-air system. By contrast, the compressor unit runs without any load in the no-load phase so that, although a piston movement takes place, no compressed air reaches the compressed-air system. This compressed air is discharged to the outside. Since, in the no-load phase, as a result of the eliminated load in comparison to the delivery phase, considerably less power is received by the compressor unit, this type of air demand control contributes to the saving of energy.

However, long-term tests have shown that the air-demand-controlled compressor arrangement is often operated with very brief switch-on durations of 5 to 10% in the delivery phase, which is the result of the predominant long-distance hauling operation on a turnpike. In the case of this brief switch-on time, the comparatively long switch-on duration of approximately 90% of the no-load phase becomes quite important so that, because of the still considerable power consumption in the no-load phase, the energy consumption in the no-load operation is, on the whole, higher than in the load operation. This result is intensified by the fact that the compressor unit capacity is often over sized for normal operation in order to generate high pressure in the compressed-air system within a very short time. This applies particularly to the charging of the compressed-air system when the pressure reservoirs are empty, to the operation of lifting axles, etc. Thus, on the whole, the known air demand control for saving energy is still quite unsatisfactory.

Furthermore, in the general state of the art, an air demand control is also known which uses an operable disconnecting coupling between the motor unit and the compressor unit, whereby the compressor unit is stopped when there is no demand for compressed air. However, in comparison to a continuous no-load operation, a compressor unit operated in this manner has fairly high wear as a result of a lack of a lubricating effect during the cold start. Furthermore, also the operable disconnecting coupling required for this air demand control is subject to wear so that, in the case of this alternative solution, on the whole, fairly high maintenance expenditures are required. Another disadvantage is the fact that, because of the complete power flux separation by means of the disconnecting coupling, no possibility exists for driving diverse auxiliary aggregates—such as the steering booster or the hydraulic pump.

It is therefore an object of the present invention to further improve an air-demand-controlled compressor arrangement of the above-mentioned type such that a more effective savings of energy of the compressor arrangement is ensured while the maintenance expenditures are simultaneously kept to a minimum.

The object is achieved based on an air-demand-controlled compressor arrangement, for commercial vehicles, having a motor unit for generating a rotating movement which, by way of an interposed rotational-speed-transmitting transmission unit, drives a compressor unit for generating compressed air from the ambient air. A control unit triggers the generating of compressed air in the case of a compressed-air demand. The transmission unit is constructed in the manner of a transmission whose rotational speed can be varied. The control unit interacts with the transmission unit in order to adapt the rotational speed of the transmission unit corresponding to the compressed-air demand, in which case the compressed-air demand can be determined via a mechanical or electric pressure sensor determining the actual pressure. The control unit connected with the pressure sensor signals a compressed-air demand precisely when the actual pressure falls under a predefined desired pressure, for triggering the transmission unit. Advantageous further developments of the invention are described and claimed herein.

The invention includes the technical teaching that the transmission unit, which is used within the scope of a compressor arrangement, is constructed in the manner of a transmission with a variable rotational speed, and that the control unit interacts with the transmission unit in order to adapt the rotational speed of the transmission unit corresponding to the compressed-air demand.

The advantage of the solution according to the invention particularly is the fact that, in contrast to known measures for saving energy, the high fraction of the energy consumption in the predominant no-load operation of the compressor unit is considerably reduced because the rotational speed of the compressor unit is decreased in this case. The adaptation of the compressor performance to the pressure demand achieved thereby is therefore based on an analogous variation of the rotational speed of the compressor, so that a direct dependence of the rotational speed of the compressor on the rotational speed of the engine and a conventionally interposed transmission with a fixed transmission ratio is eliminated.

Furthermore, in the case of the solution according to the invention, the control unit has an influence on the transmission connected in front of the compressor unit and not directly on the compressor unit, in order to cause a savings of energy. Because the air demand control here does not operate by way of only a switching-on and switching-off of the compressor unit, the wear within the compressor arrangement remains low. Also, the solution according to the invention permits the driving of diverse auxiliary aggregates—such as the brake booster or the hydraulic pump—permanently at the rotational speed minimally required for this purpose.

The transmission unit whose rotational speed can be varied may be constructed as a change-speed gear box which can be shifted by way of the control unit. Tests have shown that a 2-position change-speed gear box is completely sufficient for this purpose. However, the transmission unit whose rotational speed can be varied may also be constructed as a continuously adjustable transmission whose triggering also takes place by way of the control unit. A continuously adjustable transmission does not require high-expenditure automatic operating devices and provides the spectrum of the transmission ratio required for the present application.

The triggering of the transmission unit for varying the rotational speed can take place, for example, by way of a pneumatic signal generated by the control unit. It is also contemplated to implement the triggering by way of an electric signal. In the latter case, the electric signal for triggering the transmission unit should advantageously be generated by a higher-ranking vehicle control in which the control unit for the transmission unit is integrated.

The compressed-air demand is preferably determined by means of an electric pressure sensor determining the ACTUAL pressure, in which case the control unit connected with the pressure sensor signals a compressed-air demand precisely when the ACTUAL pressure falls below a predefined DESIRED pressure, for triggering the transmission unit. However, it is also contemplated to use, as an alternative to an electric pressure sensor, a mechanical pressure sensor which detects the ACTUAL pressure in the compressed-air system, for example, by way of a spring-loaded diaphragm-tappet arrangement, or the like.

DETAILED DESCRIPTION OF THE DRAWINGS

Figure 1:
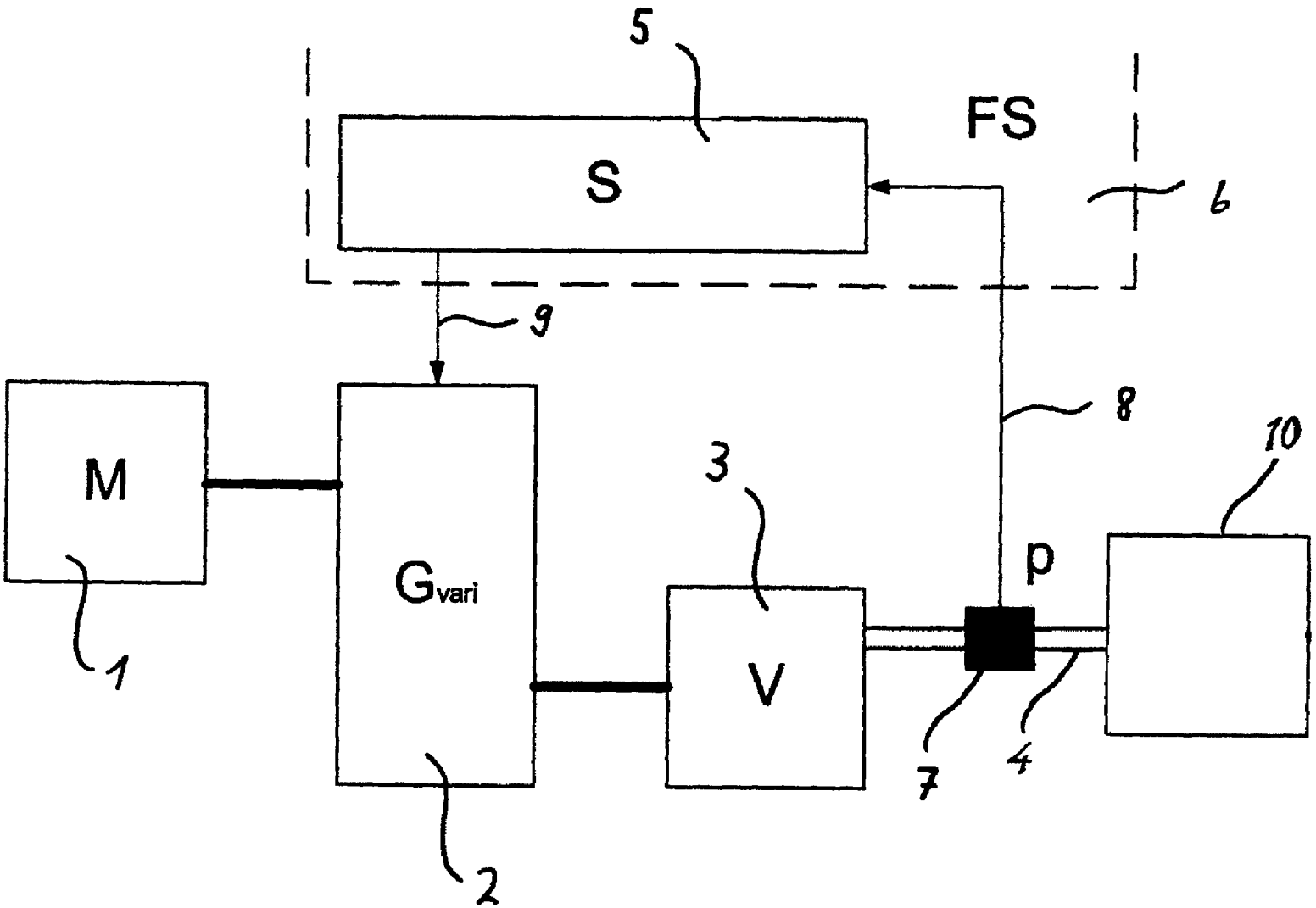
FIG. 1 is a schematic block diagram of an air-demand-controlled compressor arrangement for a commercial vehicle.

Referring to FIG. 1, the compressor arrangement consists essentially of a motor unit 1 for generating a rotational movement, here, the internal-combustion engine of the commercial vehicle. The generated rotational movement is fed to an output-side transmission unit 2 and is geared down. On the output side of the transmission unit 2, a compressor unit 3 is arranged, which compressor unit utilizes the rotational movement for generating compressed air from ambient air in a conventional manner. The compressed air generated by the compressor unit 3 is provided on the output side, by way of a compressed-air line 4, to a compressed-air system 10 of the commercial vehicle.

Furthermore, the compressor arrangement also includes devices for performing air-demand control by way of influencing the rotational speed of the transmission unit 2. The rotational speed of the transmission unit can be varied and, here, is constructed as a continuously adjustable transmission. An electronic control unit 5 is provided for triggering the continuously adjustable transmission unit 2.

The electronic control unit 5 is a component of the electronic vehicle control 6 of the commercial vehicle. The compressed-air demand of the compressed-air system of the commercial vehicle is determined through use of an electric pressure sensor 7. The electric pressure sensor 7 determines the ACTUAL pressure and provides its signal to the control unit 5 on the input side by way of an electric signal line 8. The control unit 5 compares the ACTUAL pressure with a stored predefined DESIRED pressure, which defines a limit pressure of the pressure system under which the pressure should not fall. In the event of the occurrence of this limiting case, the control unit 5 of the transmission unit 2, whose rotational speed can be varied, signals by way of an electric signal line 9, a command for increasing the transmission ratio, so that the output-side rotational speed for driving the compressor unit 3 under load rises in order to meet the compressed-air demand signaled by way of the pressure sensor 7. When an upper pressure threshold value is reached in the pressure system, it is signaled to the transmission unit 2, whose rotational speed can be varied, by means of a corresponding command that the transmission ratio must change again such that a low rotational speed for driving the compressor unit 3 is provided to the output side of the transmission unit 2, whose rotational speed can be varied, and the compressor unit 3 starts the no-load operation.

The air-demand-control according to the invention requires only a minimal amount of maintenance of the mechanical components of the compressor arrangement and is distinguished by high-efficiency savings of energy.

The invention is not limited to the above-mentioned embodiment but also comprises modifications thereof which are included in the scope of the claims. Thus, the invention is not solely limited to an electronic pressure sensing system. A pneumatic-mechanical detection of the system pressure and its transmission to a suitable control unit is also possible. Furthermore, the transmission unit, whose rotational speed can be varied, can also be pneumatically operated by way of a compressed-air line, in which case the power for operating the transmission unit, whose rotational speed can be varied, can simultaneously also be transmitted by way of the pneumatic signal.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

TABLE OF REFERENCE NUMBERS

1 Motor unit
2 transmission unit whose rotational speed can varied
3 compressor unit
4 compressed-air line
5 control unit
6 vehicle control
7 pressure sensor
8 electric signal line
9 electric signal line

What is claimed is:

1. Air procuring system of a commercial vehicle, comprising:

an air-demand-controlled compressor arrangement, including a motor unit for generating a rotating movement which, by way of an interposed rotational-speed-transmitting transmission unit, drives a compressor unit for generating compressed air from the ambient air used in one of a braking system, and an air suspension system of the commercial vehicle;

an output compressed-air line of the compressor unit connected to a compressed air system supplying air to one of the braking system and suspension system of the commercial vehicle;

a control unit for reducing a rotational speed of the compressor generating compressed air when a no-load condition is determined in one of the braking and air suspension systems and for increasing a rotational speed of the compressor when a compressed-air demand is determined, to meet the compressed air demand of the one of the braking and air suspension systems;

wherein the transmission unit is constructed in the manner of a transmission whose rotational speed is variable, and the control unit interacts with the transmission unit in order to adapt the rotational speed of the transmission unit to meet the compressed-air demand of one of the braking system and suspension system of the commercial vehicle; and further wherein the compressed-air demand and the no load condition are determined via a mechanical or electric pressure sensor determining the actual pressure, the control unit connected with the pressure sensor signals a compressed-air demand precisely when the actual pressure falls under a predefined desired pressure, for triggering the transmission unit.

2. Air-demand-controlled compressor arrangement according to claim 1, wherein the triggering of the transmission unit takes place by way of a pneumatic signal generated by the control unit.

3. Air-demand-controlled compressor arrangement according to claim 1, wherein, by way of the transmission unit, in addition to the compressor unit, a steering booster unit and/or a hydraulic pump can also be permanently driven as auxiliary aggregates, the control unit also taking into account the rotational speed or power demand of the auxiliary aggregates when triggering the transmission unit.

4. Air-demand-controlled compressor arrangement according to claim 1, wherein the transmission unit, whose rotational speed can be varied, is constructed as a change-speed gear box which can be shifted by way of the control unit.

5. Air-demand-controlled compressor arrangement according to claim 1, wherein the triggering of the transmission unit takes place by way of an electric signal generated by the control unit.

6. Air-demand-controlled compressor arrangement according to claim 4, wherein, by way of the transmission unit, in addition to the compressor unit, a steering booster unit and/or a hydraulic pump can also be permanently driven as auxiliary aggregates, the control unit also taking into account the rotational speed or power demand of the auxiliary aggregates when triggering the transmission unit.

7. A commercial vehicle, comprising:

an air-demand-controlled compressor arrangement, including a motor unit for generating a rotating movement which, by way of an interposed rotational-speed-transmitting transmission unit, drives a compressor unit for generating compressed air used in one of a braking system, and an air suspension system of the commercial vehicle;

an output compressed-air line of the compressor unit connected to a compressed air system supplying air to one of the air braking and suspension system of the commercial vehicle; and a control unit for reducing a rotational speed of the compressor generating compressed air when a no load condition is sensed in one of the braking and air suspension systems, and for increasing a rotational speed of the compressor in response to determining a compressed-air demand, to meet the compressed air demand of the one of the braking and air suspension systems;

wherein the transmission unit has a variable rotational speed and the control unit interacts with the transmission unit to adapt the rotational speed thereof to meet the compressed-air demand of one of the braking system and suspension system of the commercial vehicle; and wherein the compressed-air demand and the no load condition are determined via a mechanical or electric pressure sensor measuring an actual pressure, operatively connected to the control unit, the control unit triggering the transmission unit when the actual pressure falls under a predefined desired pressure.

8. A commercial vehicle, comprising:

an air-demand-controlled compressor arrangement, including a motor unit for generating a rotating movement which, by way of an interposed rotational-speed-transmitting transmission unit, drives a compressor unit for generating compressed air;

an output compressed-air line of the compressor unit connected to a compressed air system supplying air to one of a compressed air braking and suspension system of the commercial vehicle;

a control unit for controlling generation of compressed air to meet a compressed-air demand of one of the braking system and suspension system of the commercial vehicle by increasing a rotational speed of the compressor when an actual pressure is less than a predefined desired pressure in one of the braking and air suspension systems, and by reducing the rotational speed thereof when the actual pressure reaches an upper threshold in the one of the braking and air suspension systems; and pressure sensors for measuring the actual pressure in the one of the braking and air suspension system, operatively connected to the control unit.

* * * * *

UNITED STATES PATENT AND TRADEMARK OFFICE

CERTIFICATE OF CORRECTION

PATENT NO. : 7,600,988 B2
APPLICATION NO. : 10/652619
DATED : October 13, 2009
INVENTOR(S) : Doerr et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1009 days.

Signed and Sealed this

Fifth Day of October, 2010

David J. Kappos

David J. Kappos
*Director of the United States Patent and Trademark Office*